US009418637B1

(12) United States Patent
Akbari et al.

(10) Patent No.: US 9,418,637 B1
(45) Date of Patent: Aug. 16, 2016

(54) METHODS AND SYSTEMS FOR VISUAL MUSIC TRANSCRIPTION

(71) Applicant: claVision Inc., Lethbridge (CA)

(72) Inventors: Mohammad Akbari, Burnaby (CA); Howard Cheng, Lethbridge (CA)

(73) Assignee: claVision Inc., Lethbridge (CA)

( * ) Notice: Subject to any disclaimer, the term of this patent is extended or adjusted under 35 U.S.C. 154(b) by 0 days.

(21) Appl. No.: 14/664,655

(22) Filed: Mar. 20, 2015

(51) Int. Cl.
*G04B 13/00* (2006.01)
*G10H 1/36* (2006.01)
*G10G 1/04* (2006.01)

(52) U.S. Cl.
CPC ..... *G10G 1/04* (2013.01)

(58) Field of Classification Search
USPC ..... 84/475
See application file for complete search history.

(56) References Cited

U.S. PATENT DOCUMENTS 5,523,525 A * 6/1996 Murakami ..... G09B 5/065 348/460
7,242,388 B2 * 7/2007 Lieberman ..... H03K 17/9638 345/156
7,295,752 B1 11/2007 Jain et al.
7,338,690 B2 3/2008 Takaku et al.
7,582,825 B2 * 9/2009 Chien ..... G09B 15/08 84/477 R
7,599,554 B2 10/2009 Agnihotri et al.
8,121,432 B2 2/2012 Dorai et al.
2003/0133700 A1 7/2003 Uehara
2014/0096667 A1 * 4/2014 Chapman ..... G10H 1/0058 84/609

* cited by examiner

*Primary Examiner* — Christopher Uhlir
(74) *Attorney, Agent, or Firm* — Davis Wright Tremaine LLP; Heather M. Colburn

(57) ABSTRACT

Methods, systems, and techniques for visual automatic transcription of music played on a musical keyboard instrument. The system receives a video input of the musical instrument being played. A transcribing application detects a keyboard section of a background frame of the video input by detecting a shape of the keyboard and the presence of keys in the shape. The keys are detected in the background image and the positional information and associated musical notes of each key is determined. A difference image is obtained by subtracting the background image from the current frame. A musical note is determined for the pressed key based on the positional information and associated musical notes of the keys in the background image.

20 Claims, 11 Drawing Sheets

205

1100

METHODS AND SYSTEMS FOR VISUAL MUSIC TRANSCRIPTION

TECHNICAL FIELD

The present disclosure relates to music transcription and, in particular, to automatic visual music transcription.

BACKGROUND

Automatic Music Transcription (AMT) is the process of automatically converting music to a symbolic notation such as a music score or a Musical Instrument Digital Interface (MIDI) file using a computer. Since manually transcribing music to sheet music is a time consuming step of music composition, professional musicians and composers may use AMT to speed up this process. Audio processing techniques may be used to analyze the pitches and frequencies in a piece of music in order to extract the played notes. Once the notes are extracted, the music may be transcribed.

The transcribed music score may be used as an alternate compact representation for the computer to store, reproduce, and play the music. This information may be used in the analysis and arrangement of the piece of music. Music transcription may allow music to be shared between users. Moreover, a composer may have the task of music transcription automated as the music is being improvised or composed. Thus, manual music transcription may be replaced by automatic and fast music transcription.

SUMMARY

According to one aspect, there is provide a computer implemented method of transcribing music played on a musical keyboard instrument, the method comprising using a processor for receiving an image input of the musical keyboard instrument being played. The image includes at least a played portion of the keyboard, wherein the image is captured from a position showing a change in position of a key being pressed. The method also includes locating a keyboard section of a background image of the image input. The method also includes assigning a musical note to at least one key located in the keyboard section. The method further includes locating a pressed key in an image subsequent to the background image by comparing at least a portion of the keyboard section of the background image to a keyboard section of the subsequent image. The method also includes determining a musical note for the pressed key based on the musical note assigned to a corresponding key in the keyboard section of the background image and outputting an output based on the musical note of the pressed key.

The method may also include comparing at least a portion of the keyboard image in the background image to the keyboard image in the subsequent image by subtracting the keyboard image in the background image from the keyboard image in the subsequent image to produce a positive difference image and a negative difference image, the positive difference image comprising positive pixel values and the negative difference image comprising negative pixel values.

The method may also include selecting the background image comprising the keyboard section, the keyboard section comprising light keys and dark keys, by analyzing images of the image input until the keyboard is located in one of the images by detecting at least one quadrilateral in the image and selecting from the at least one detected quadrilateral a keyboard quadrilateral in which a bottom one third portion has a higher average brightness and a top two thirds portion comprises more dark keys than any other detected quadrilateral.

The method may also include updating the background image with an image from the image input in which the keyboard section, comprising light keys and dark keys, has a higher average brightness in its bottom one third portion and more dark keys in its top two thirds portion than the keyboard section of the background image.

The method may also include normalizing an image subsequent to the background image to reduce differences caused by illumination, noise, and shadows by adjusting pixel values in the image using pixel values in a previous image of the image input, wherein the image is normalized prior to detecting the pressed key.

The method may also include detecting a hand and/or a finger in the subsequent image and limiting the locating of the pressed key to a region bounding the hand and/or the finger.

The method may also include locating the keys in the background image, comprising dark keys and light keys, by locating dark keys using their contrast with light keys and determining positions for the light keys relative to the dark keys.

The method may also include locating a key in the background image by determining coordinates of a keys quadrilateral for the key, wherein the keys quadrilateral is a representation of the key.

The method may also include determining the musical note for the pressed key by mapping the keys quadrilaterals to the difference images and assigning to the pressed key the musical note associated with the mapped quadrilateral that includes the pressed key.

The method may also include assigning the located keys to octaves. The located keys comprise dark keys and light keys. The octaves are determined based on groups of sequentially arranged dark keys, each group comprising two dark keys separated from three dark keys only by two light keys.

The image input in the method may include a video.

The output in the method may include sheet music.

The method may include producing sheet music by mapping the musical note to a corresponding musical symbol based on note duration and arranging the musical symbol in a staff based on the musical note. The note duration is determined by the length of time the pressed key is pressed for.

The method may also include transforming the keyboard section of the background image into a rectangular image.

The method may also include highlighting a pressed key in an image of the image input.

The method may also include using acoustic automatic musical transcription to acoustically determine the musical note corresponding to the pressed key, wherein the image input further comprises audio input.

The method may also include basing the output on the acoustically determined musical note if either the pressed key or the acoustically determined musical note corresponds to a key that has low visual detectability.

According to another aspect, there is provided a non-transitory computer readable medium having stored thereon program code to cause a processor to perform a method for transcribing music played on a musical instrument having a keyboard, the method comprising receiving an image input of the musical keyboard instrument being played. The image input includes at least a played portion of the keyboard, wherein the image is captured from a position showing a change in position of a key being pressed. The method also includes locating a keyboard section of a background image of the image input. The method also includes assigning a musical note to at least one key located in the keyboard section. The method further includes locating a pressed key in an image subsequent to the background image by comparing at least a portion of the keyboard section of the background image to a keyboard section of the subsequent image. The method also includes determining a musical note for the pressed key based on the musical note assigned to a corresponding key in the keyboard section of the background image and outputting an output based on the musical note of the pressed key.

According to another aspect, there is provided a computer implemented method of locating keys played on a musical keyboard instrument, the method comprising using a processor for receiving an image input of the musical instrument being played, comprising at least a played portion of the keyboard. The image may be captured from a position showing a change in position of a key being pressed. The method also includes locating a keyboard section of a background image of the image input and locating keys in the keyboard section. The method further includes locating a pressed key in an image subsequent to the background image by subtracting the keyboard section of the background image from the keyboard section of the subsequent image to produce a positive difference image and a negative difference image, wherein the positive difference image is used for locating a pressed key having negative pixel values and the negative difference image is used for detecting a pressed key having positive pixel values. The method also includes outputting an output based on the pressed key.

According to another aspect, there is provided a system for automatically visually detecting musical notes played on a musical keyboard instrument. The system includes a camera for providing an image input of the musical instrument being played, comprising at least a played portion of the keyboard. The image is captured from a position showing a change in position of a key being pressed. The system also includes a computing device communicatively coupled to the camera, the computing device comprising a computer readable memory and a processor operably coupled with the computer readable memory. The system further includes a transcribing application stored on the computer readable memory for execution by the processor for receiving the image input, locating a keyboard section of a background image of the image input and assigning musical notes to keys located in the keyboard section, locating a pressed key in an image subsequent to the background image by comparing at least a portion of the keyboard section of the background image to a keyboard section of the subsequent image, determining a musical note for the pressed key based on the musical note assigned to a corresponding key in the keyboard section of the background image and outputting an output based on the musical note of the pressed key.

BRIEF DESCRIPTION OF THE DRAWINGS

In the accompanying drawings, which illustrate one or more example embodiments.

DETAILED DESCRIPTION

Figure 1:
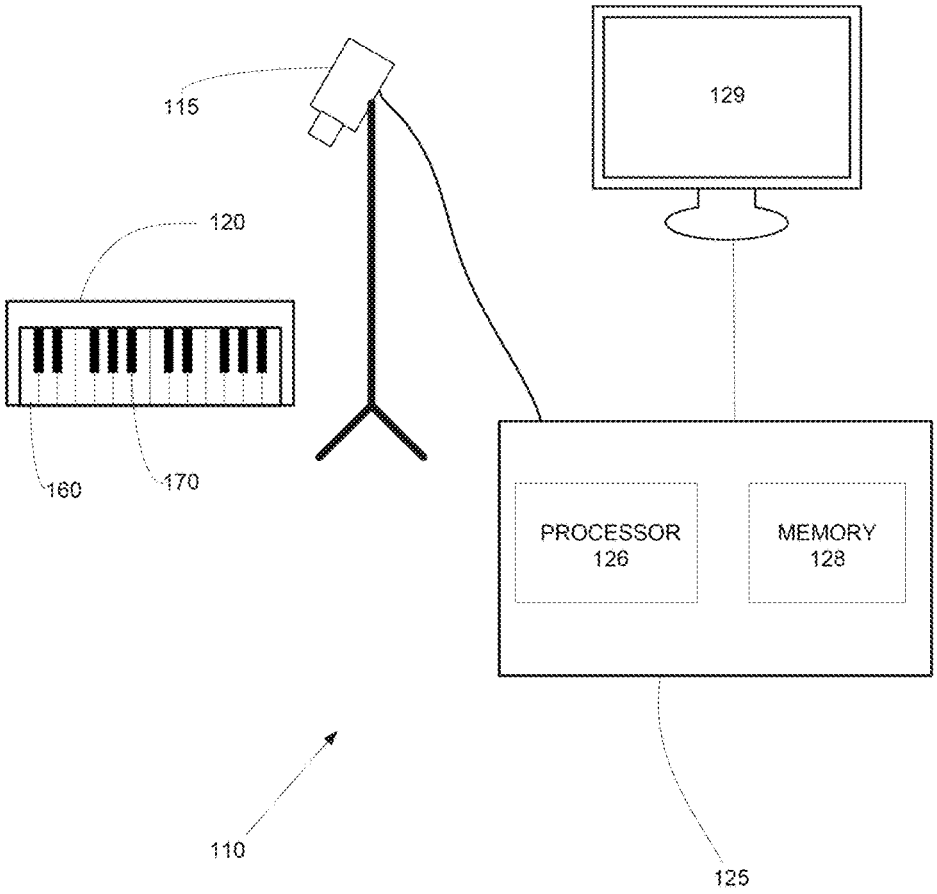
FIG. 1 is a block diagram of a system for automatically visually detecting musical notes played on a musical instrument having a keyboard, according to one embodiment.

Directional terms such as "top", "bottom", "upper", "lower", "left", "right", and "vertical" are used in the following description for the purpose of providing relative reference only, and are not intended to suggest any limitations on how any article is to be positioned during use, or to be mounted in an assembly or relative to an environment. Additionally, the term "couple" and variants of it such as "coupled", "couples", and "coupling" as used in this description are intended to include indirect and direct connections unless otherwise indicated. For example, if a first device is coupled to a second device, that coupling may be through a direct connection or through an indirect connection via other devices and connections. Similarly, if the first device is communicatively coupled to the second device, communication may be through a direct connection or through an indirect connection via other devices and connections.

AMT is the process of extracting the musical notes from a piece of played music and transcribing them to musical notations. Prior art AMT methods have been based on audio processing techniques. These methods do not tend to be very accurate or efficient in the transcription tasks because of a number of difficulties. For example, at any instance in time, there may be multiple lines of music (melodies and chords) being played, such as, in polyphonic and homophonic music. The combination of various audio signals may make it difficult to distinguish all the notes that are played at the same time. Similarly, if two or more instruments are played together (e.g., in an orchestra), several lines of music are produced at the same time. It is difficult to isolate the music played by one instrument from the others. Additionally, the process can be susceptible to background noise causing problems in extracting the main audio signal. Detecting the duration of a note from an audio signal may also be problematic because the onset (the beginning of the musical note) and offset (the end of the musical note) of the played notes may not be accurately detected. Furthermore, if the instrument is not properly tuned, it may be difficult to extract the played notes correctly by identifying the correct pitches of the notes.

The present disclosure provides a system and method, referred to here as Visual Automatic Music Transcription (VAMT), for visually extracting musical notes played on a musical instrument. The musical notes may then be transcribed to corresponding symbolic notation. A video of the instrument used for playing the music is captured during the performance and is analyzed using video processing techniques. Then, according to the visual features, the notes played on the instrument are detected and transcribed.

The video may be captured using a camera located above a keyboard of, for example, a piano, during a musical performance. The played music is visually analyzed based on the pressed keys and the musician's hands. The played music is automatically transcribed. VAMT, as described herein, may be used to transcribe live performances in real-time or prerecorded performances. In embodiments of the present disclosure, musical keyboards such as, but not limited to, pianos, harpsichords, and electronic organs may be analyzed.

Using VAMT, multiple played notes may be distinguished because it can detect multiple keys pressed simultaneously. The presence of other instruments being played is unlikely to affect VAMT. Additionally, the subject matter of the current disclosure may be useful for users learning, for example, a piano. Using VAMT, mistakes made by the user when playing a piece of music may be seen in the output and may be, for example, highlighted keys on the video of the performance or sheet music. Even if the musical instrument is not tuned properly, using VAMT, the played music may be transcribed. Additionally, VAMT may be used to produce audio output based on the transcription of the performance in a video.

Referring to FIG. 1, a system 110 for transcribing played music to musical notes is shown. A camera 115 records a video image of a keyboard 120 during a musical performance. The camera 115 is communicatively coupled to a computer 125 comprising a processor 126 and a computer readable memory 128, the computer 125 operably coupled to a display 129. The memory has stored on it a transcribing application executable by the processor for visual automatic transcription of music. The computer 125 receives the video from the camera 115 where it is processed by the processor 126 running the transcription application.

The keyboard 120 comprises light keys 160 and dark keys 170. In some embodiments, the dark keys 170 may comprise black keys and the light keys 160 may comprise white keys. The light keys 160 are for playing the natural notes and the dark keys 170 are for playing the modifiers for the natural notes. In some embodiments, the keys for the natural notes may be of a darker colour than the keys for the modifiers for the natural notes. However, in this disclosure, keys for the natural notes are referred to as light keys and the keys for the modifiers for the natural notes are referred to as dark keys regardless of their actual colour.

Any suitable camera may be used, for example the camera 115 may be a digital video camera with a spatial resolution of about 320×240 and a frame rate of about 24 frames per second ("FPS"). This resolution and frame rate may provide accuracy and short processing times. In some embodiments, cameras with resolutions of 640×360 and frame rates of 30 FPS are used. In certain embodiments, other cameras with suitable frame rates and resolutions for capturing a video showing keys being pressed on the keyboard 120 during a musical performance may be used.

In some embodiments, non-digital cameras may be used to record the keyboard being played. The recorded video can be converted to a digital video file prior to it being processed by the transcribing application.

The camera 115 is positioned to view the keyboard 120 using a stand. In certain embodiments, any kind of suitable mount for positioning the camera 115 to view the keyboard 115 may be used.

The camera 115 is positioned over the keyboard 120 such that an image of a played portion of the keyboard 120 is captured. The keys that are played are visible in the image captured by the camera 115. In some embodiments, the entire keyboard 120 is visible in the images captured by the camera 115. In certain embodiments, only the portion of the keyboard 120 that includes the played keys is visible in the images captured by the camera 115.

The camera 115 is positioned above the keyboard 120 in a position suitable for capturing images showing a change in position of any key being pressed. In this embodiment, as seen in FIG. 1, the camera 115 is positioned above the keyboard 120 at a slight offset from the keyboard 120 so that it is not directly over any part of the keyboard 120. The camera 115 captures images of the keyboard 120 at an angle to the vertical. For example, the camera 115 may capture images of the keyboard 120 at an angle of about 30 degrees to about 45 degrees from the vertical, such that all the keys are visible while being pressed. The camera 115 may be positioned at any suitable position above the keyboard 120. For example, in some embodiments, the camera 115 may be positioned above the keyboard 120 to capture images at an angle to the vertical greater than about 0 degrees and less than about 45 degrees.

Images captured by the camera 115 from a position that produces an angled or rotated view of the keyboard 120 may be transformed by the transcribing application to a rectangular image of the keyboard 120 that has been modified to account for factors such as, for example, perspective and rotation.

In FIG. 1, the camera 115 is connected to the computer 125 by a communications cable such as, for example, a USB cable, for transmitting images to the computer 125. In some embodiments, the camera 115 may be connected to the computer 125 wirelessly. The transcribing application may automatically detect all cameras connected to the computer 125.

In certain embodiments, the camera 115 may be located at a remote location from the computer 125 and the images may be transferred to the computer 125 over a network. For example, the images may be transferred over a Wi-Fi network or over a cellular network. The images may be transferred over the internet. The images may be transmitted in real time as a live stream, as the images are being recorded. In some embodiments, the images may be transmitted as a stream with a delay between recording and transmitting.

In some embodiments, the recorded images may be stored on a memory unit on the camera 115 and then transferred, either through a direct wired or wireless connection to the computer 125 or by using an external memory unit, such as, for example, an SD card, for storing and transferring the images to the computer 125.

In some embodiments, the camera 115 may be integrated with the computer 125. For example, the camera 115 may be part of a mobile device such as a cellular phone or a tablet computer. The camera 115 may also be a webcam integrated with a laptop computer. The computer 125 may also be part of the mobile device and the transcription application may be stored on the memory 128 on the mobile device.

In some embodiments, the camera 115 may be external to the system 110 and may be operated by a third party. The images recorded by the camera 115 may be transferred to the computer 125 through various means, such as, for example, over the internet or with a portable memory unit. For example, a user may download images of a keyboard being used in a musical performance to the computer 125 from an internet service. This may include, for example, downloading a video from YouTube. The images may also be transferred to the computer 125 through email.

In some embodiments, the transcribing application may be stored on a server and users may connect to the server to use the transcribing application. For example, the transcribing application may be stored on a cloud-based platform and a user may use the transcribing application online without installing it on their computer. The user may provide the cloud based transcribing application pre-recorded images of a musical performance or a live-stream from the camera 115.

Figure 2:
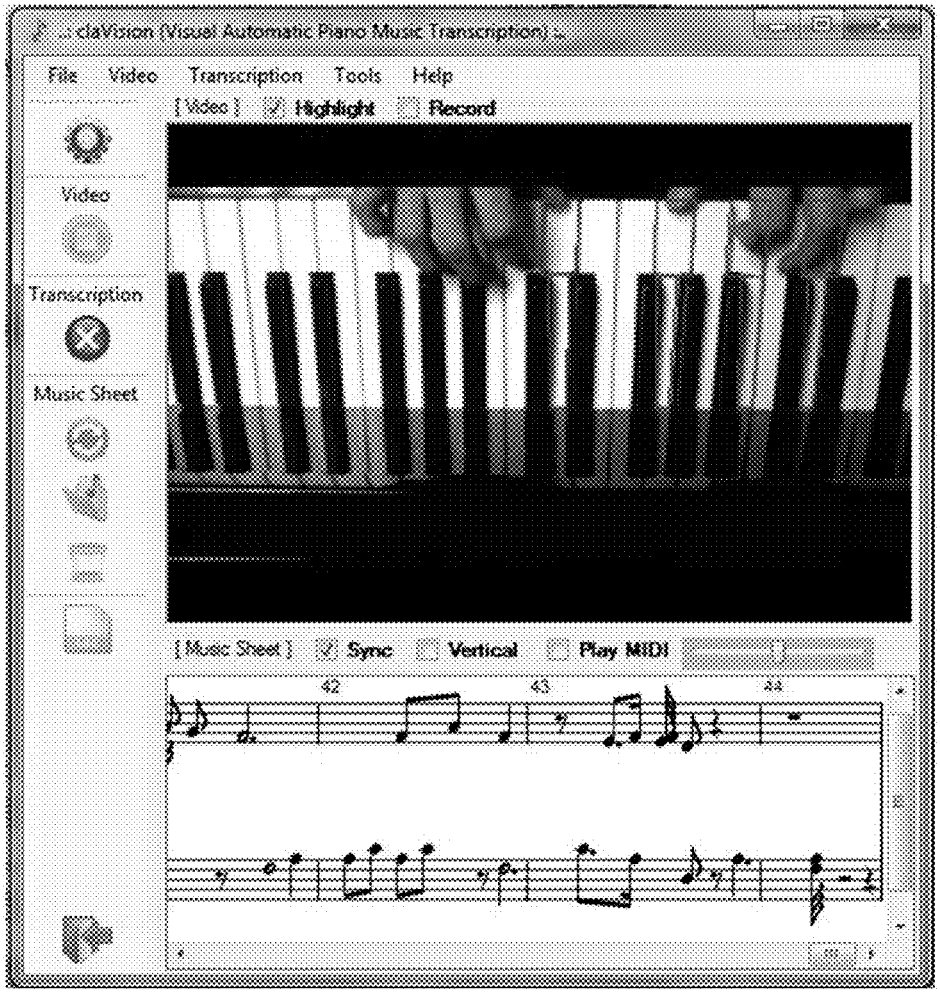
FIG. 2 is an example of a graphical user interface of a transcribing application comprising part of the system of FIG. 1.

Referring to FIG. 2, the transcribing application may include a graphical user interface ("GUI") 205 that may be displayed on the display 129. A user may view the received video or images in the GUI 205. The output produced by the transcribing application may also be displayed in the GUI 205. For example, digital sheet music may be displayed in the GUI 205 as the images are processed by the transcribing application. In one embodiment, both the images and the sheet music are displayed. The GUI 205 may also show a cropped image of the keyboard 120. In some embodiments, keys may be highlighted on the image of the keyboard 120 as they are pressed in the images. The image of the keyboard 120 may also show the names of the notes on the keys. In some embodiments, the GUI 205 may display various processing tasks as the transcribing application processes the images. For example, quadrilaterals representing the keys may be displayed on an image of the keyboard 120. Similarly, difference images may be shown. A user may be able to customize the GUI 205 and set preferences for what should be displayed.

In some embodiments, the GUI 205 may also contain an entry field for the user to enter information, such as, for example, an instrument name, tempo, and a time signature. These may be displayed on the sheet music. The user may also be able to enter file locations of videos into the GUI 205 for the transcribing application to retrieve and process. Videos or other types of image files may also be dragged and dropped into the GUI 205. Other suitable means of directing the transcribing application to open video files may also be used.

Figure 3:
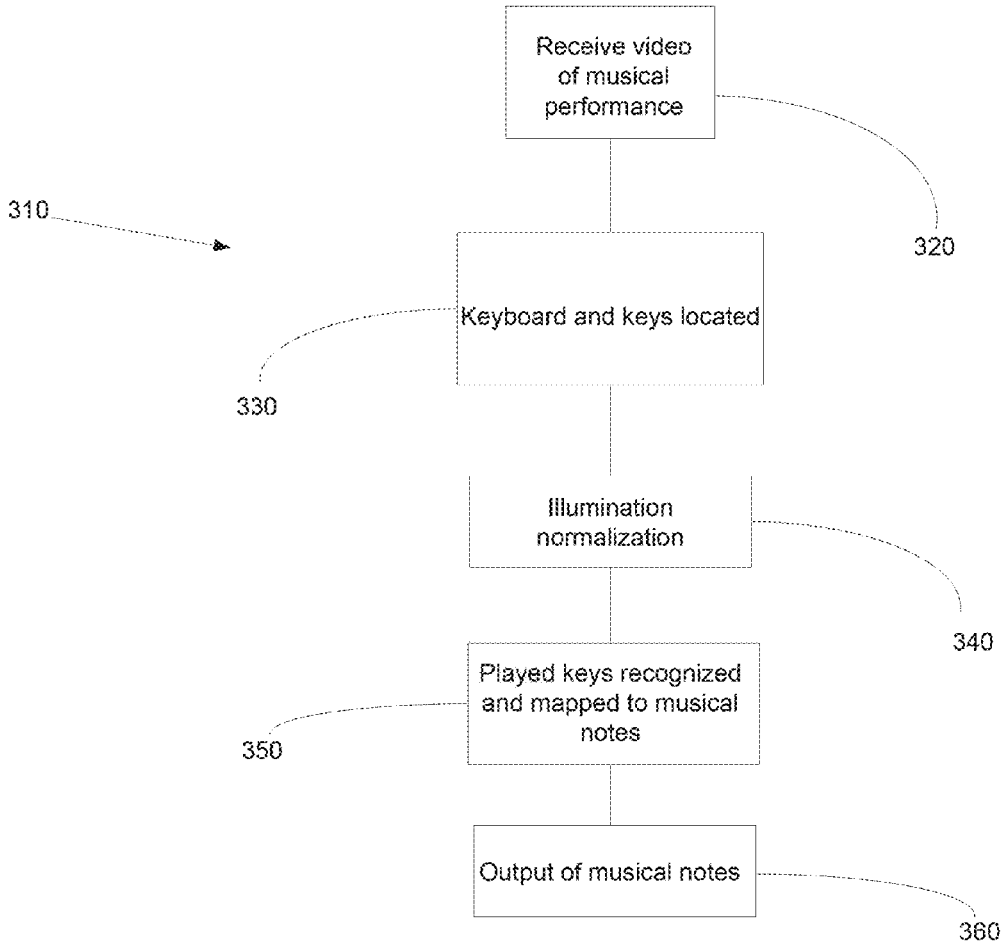
FIG. 3 is a method for transcribing music played on a musical instrument having a keyboard, according to one embodiment.

Referring to FIG. 3, a method 310 for visual automatic transcription of music played on a musical instrument comprising a keyboard is shown. At block 320, a video of a musical performance on an instrument with a keyboard is received. At block 330, the location of the keyboard and the keys on it, along with associated musical notes, are determined and registered. At block 340, a correction process is applied to each working video frame to deal with issues caused by varying illumination. At block 350, the played keys in each frame are recognized and mapped to the respective musical notes. At block 360, the obtained musical information is output.

In certain embodiments, the method 310 includes transcribing application receiving an image input, such as a video, of music played on a musical instrument having a keyboard. The image input comprises at least a played portion of the keyboard. The image is captured from a position showing a change in position of a key being pressed. A keyboard section is located in a background image of the image input and musical notes are assigned to keys located in the keyboard section. A pressed key is located in an image subsequent to the background image by comparing at least a portion of the keyboard section of the background image to a keyboard section of the subsequent image. A musical note for the pressed key is determined based on the musical note assigned to a corresponding key in the keyboard section of the background image. An output based on the musical note of the pressed key is output. In some embodiments, comparing at least a portion of the keyboard section of the background image to the keyboard section of the subsequent image comprises subtracting at least a portion of the keyboard section of the background image from the keyboard section of the subsequent image. Subtracting may comprise, for example, subtracting pixel values of corresponding pixels in the images.

In certain embodiments, the image input comprises a video. In some embodiments, the image input comprises multiple images. The image input may be converted to greyscale prior to processing.

In some embodiments, the method 310 includes the transcribing application receiving an image input of the musical instrument being played, comprising at least a played portion of the keyboard. The images are captured from above the keyboard by the camera positioned for showing a change in position of a key being pressed. An image of the keyboard is detected in a keyboard detection frame of the video input by detecting a shape of the keyboard and the presence of keys in the shape. The image of the keyboard is stored as a current background image. The transcribing application locates keys in the background image, wherein locating a key comprises determining the location of the key. A musical note is assigned to each located key through a comparison of the located keys with a set of key notations. For each frame of the video subsequent to the initial keyboard detection frame, a pressed key is detected by detecting an image of the keyboard in the frame and subtracting the current background image from the image of the keyboard in the frame to produce a difference image comprising the pressed key and locating the pressed key in the difference image. The musical note for the pressed key is determined by assigning to the pressed key the musical note associated with the located key in the background image that corresponds to the pressed key in the difference image, wherein the musical note is a rest if a pressed key is not detected in the difference image. The transcribing application outputs an output based on the musical note for each frame.

In some embodiments, each key in the current background image is located by detecting each key and determining positional information for each detected key. The musical note may be assigned to each located key in the background image by assigning the musical note to the positional information of each detected key. In certain embodiments, a musical note for the pressed key may be determined by assigning to the pressed key the musical note associated with the positional information that corresponds to a location of the pressed key in the difference image.

Referring again to FIG. 3, the images, such as a video, received at block 320 may be received from a camera. In some embodiments, the received images may be obtained from a computer readable memory, either a local memory or one located remotely, such as a web server accessible over an internet connection. The images are in digital format. The images may be received in real time as a live stream, as the images are being recorded by camera, or they may be pre-recorded images, such as a pre-recorded video. The images include a played portion of the keyboard such that the keys that are played are visible in the images. In some embodiments, the entire keyboard is visible in the images. In certain embodiments, only the portion of the keyboard that includes the played keys is visible in the images.

As discussed earlier, the images may show the keyboard from a position showing a change in position of a key being pressed. For example, in one embodiment, the images may show the keyboard from a position above the keyboard but slightly offset from the keyboard such that the keys are seen at a slight angle. A slightly angled view may provide greater contrast between pressed and non-pressed keys.

The processor, which executes the transcribing application, processes the images in accordance with executable instructions of the transcribing application.

Figure 4:
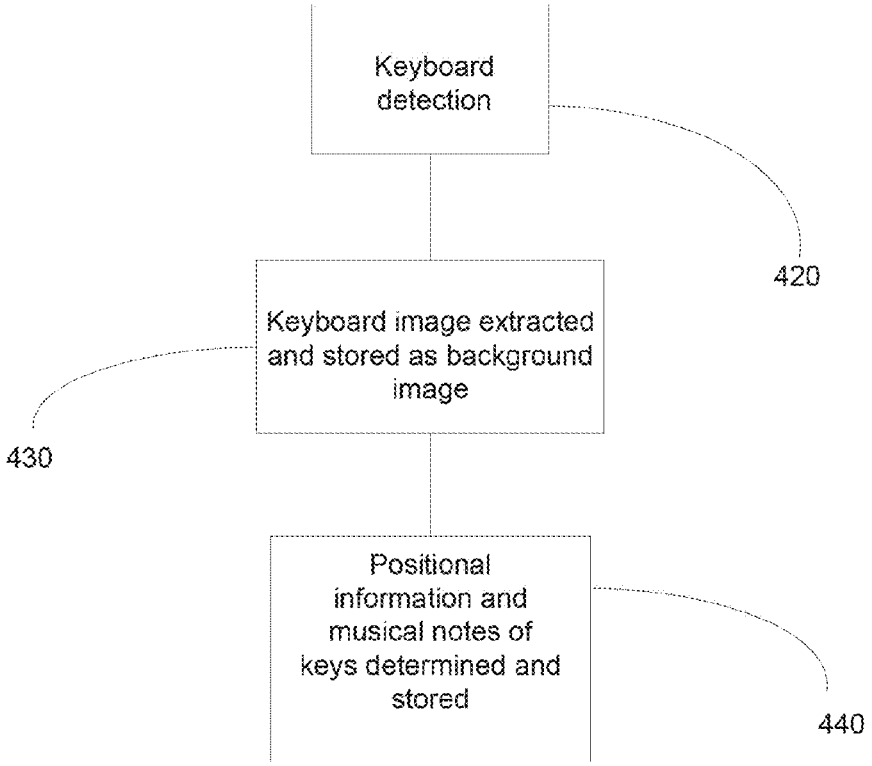
FIG. 4 is a set of tasks for detecting and registering a keyboard image in a video frame, according to one embodiment.

Referring to FIG. 4, tasks that may be performed by the transcribing application in determining and registering the location of the keyboard and its keys, as provided in block 330 of FIG. 3, are shown. Keyboard detection is shown at block 420, which may include locating, transforming, and cropping the keyboard. At block 430, an image of the keyboard is extracted from an image of the image input, such as a frame of a video, and stored as a background image. At block 440, locations of the dark keys and the light keys and their musical features are determined and stored.

In certain embodiments, multiple images of the image input, such as, for example, frames of a video input, may be analyzed until an image of the keyboard is detected. In some embodiments, the images may be sequentially analyzed.

In certain embodiments, a keyboard section of an image is detected by detecting at least one quadrilateral in the frame and selecting from the at least one detected quadrilateral a keyboard quadrilateral in which a bottom one third portion has a higher average brightness and a top two thirds portion comprises more dark keys than any other detected quadrilateral. Any suitable method for detecting quadrilaterals may be used. For example, line detectors may be used to detect lines forming a quadrilateral, as described below. In some embodiments, corner detectors may be used to detect quadrilaterals by detecting corners of a quadrilateral. For example, Harris corner detectors may be used. In certain embodiments, shape recognition using shape descriptors, such as, for example, shape numbers and statistical moments, may be used.

In some embodiments, the background image comprising the keyboard section is selected by analyzing images of the image input until the keyboard is located in one of the images by detecting at least one quadrilateral in the image and selecting from the at least one detected quadrilateral a keyboard quadrilateral in which a bottom one third portion has a higher average brightness and a top two thirds portion comprises more dark keys than any other detected quadrilateral.

The at least one detected quadrilateral used for selecting the keyboard quadrilateral may be detected by determining the positional features of sets of four lines that have four intersection points corresponding to four corners of a quadrilateral, wherein the lines in the frame are identified using a line detector.

In some embodiments, the keyboard may be represented as a quadrilateral shaped by four edges or lines. To compute the location of the keyboard, the positional features of these four lines may be extracted. Any suitable technique may be used to extract the lines. For example, a Hough line transform may be used to detect lines and extract their features in a video frame.

In some embodiments, an edge detecting technique may be used to identify the boundaries or edges of objects within the video frame before applying a line detection and extraction method, such as the Hough line transform. Any suitable technique may be used for edge detection. For example, in some embodiments, an edge detecting technique such as the Canny edge detector, may be used. In certain embodiments, other suitable edge detectors, such as the Difference edge detector or the Sobel edge detector, may be used.

The lines in the video frame may be detected on an image resulting from the application of an edge detector to the video frame. The coordinates of the lines may be calculated. For example, in one embodiment, the polar coordinates (radius and theta values) of detected lines are calculated by performing the Hough line transform on the image resulting from the edge detection technique. The polar coordinates are then converted into Cartesian coordinates.

To locate four lines forming a quadrilateral representative of the keyboard, four line combinations of the set of extracted lines are evaluated based on their intersection points. To reduce the number of candidates, combinations that result in at least four intersections in the image plane may be considered for further processing. The four intersections in each combination are considered to be the four corners of a quadrilateral. One or more quadrilaterals may be detected.

Quadrilaterals in the image may be obtained with minor distortions, such as distortions caused by rotation and perspective, for example. The quadrilaterals may be transformed to rectangular images using a quadrilateral transformation technique. In certain embodiments, the keyboard section of the background image is transformed into a rectangular image. In some embodiments at least one detected quadrilateral is transformed into a rectangular image prior to the selection of the keyboard quadrilateral.

Figure 5:
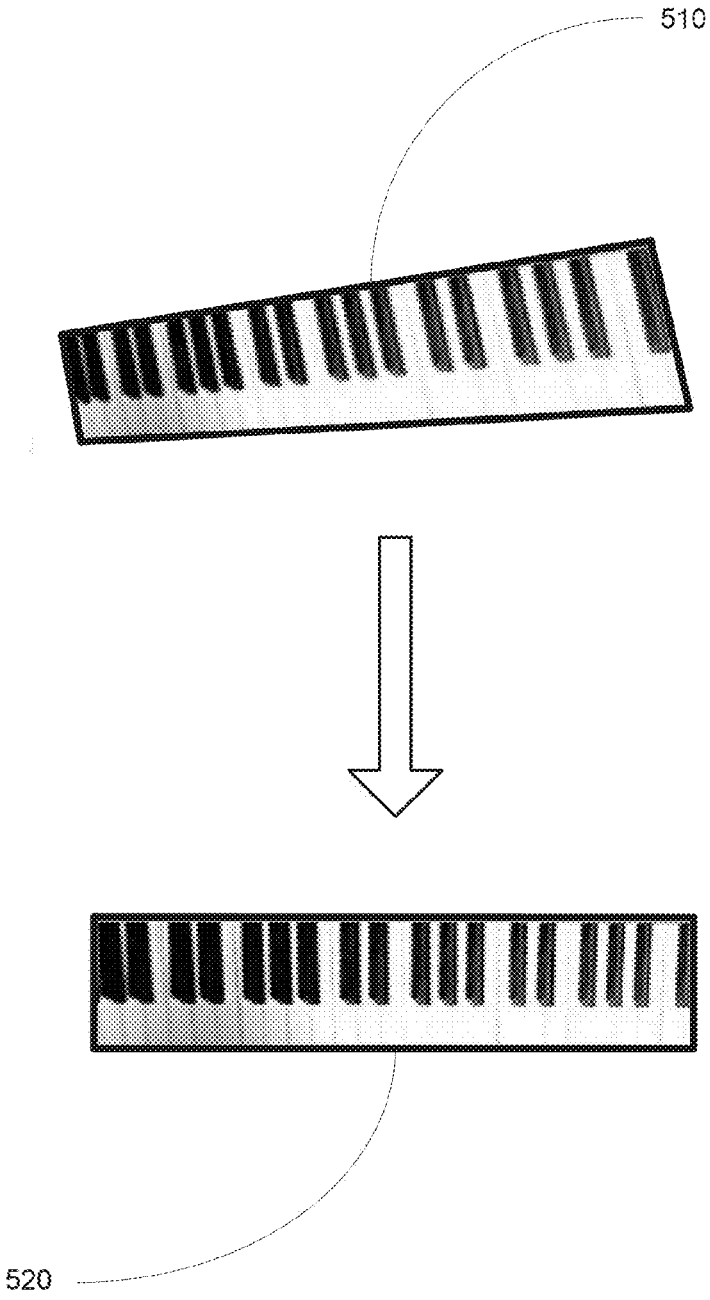
FIG. 5 is an example of transforming a quadrilateral image to a rectangular image.

Referring to FIG. 5, the transformation of a detected quadrilateral 510 to a rectangular image 520 is shown. The coordinates of the quadrilateral, which may be non-rectangular, are mapped to a rectangle. A mapping matrix may be used. In some embodiments, a homogeneous transformation technique may be used to transform the detected quadrilaterals to rectangular images using the four corners of each detected quadrilateral. Any suitable transformation techniques may be used for transforming the detected quadrilateral 510. For example, in some embodiments, the homogeneous transformation technique proposed by P. Heckbert (P. Heckbert, "Projective mappings for image warping," Master's thesis, University of California, Berkeley, 1989) may be used.

Each of the rectangular images resulting from each of the one or more detected quadrilateral images is analyzed to determine if it comprises an image of the keyboard. Musical keyboards, such as the keyboard 120 of FIG. 1, generally have dark keys placed at the top two-thirds of the keyboard. The bottom one-third does not contain dark keys. It may include, for example, light keys. Thus, in one embodiment, a quadrilateral may be considered as the keyboard if it has the fewest dark keys in a lower one-third portion and the highest number of dark keys in an upper two-thirds portion, as compared with other detected quadrilaterals.

The number of dark keys may be counted using any suitable techniques. For example, in one embodiment, the dark keys may be located using a blob extraction technique. The blob extraction technique may be based on, for example, a connected components labelling technique. Connected component labeling is used in computer vision to detect connected regions in a digital image. For example, blob extraction based on connected components labelling may be used to detect and extract objects in an imaged formed of connected black pixels, such as the dark keys of the keyboard. The blob extraction technique is used to extract and counts individual objects, or blobs, representing the dark keys in each of the one or more detected quadrilaterals.

In one embodiment, the blob extraction technique is performed on binary images. A binary image is a digital image that has one of two values for each pixel. The two values used for a binary image are generally black and white, although any two colours may be used. The colour used for an object in the image, such as a dark key, is the foreground color while the rest of the image is the background color. In this embodiment, each image in the one or more detected quadrilaterals is transformed into a binary image. A suitable threshold point is needed to transform the images to binary images, in order to determine which pixels will be black and which will be white in the binary image. Any suitable techniques, such as, for example, the Otsu clustering-based thresholding method, may be used to automatically calculate the threshold point for differentiating the objects (dark keys) from the background (light keys).

The number of dark keys located in both the bottom one-third portion and the top two-thirds portion of each of the one or more detected quadrilaterals is counted and compared between quadrilaterals. The quadrilateral that has fewer dark keys in the bottom one-third portion and more dark keys in the top two-thirds portion than any of the other quadrilaterals is selected as the keyboard section of the image.

In some embodiments, a quadrilateral may be considered as the keyboard quadrilateral if it has a higher brightness or intensity in its lower one-third portion and the highest number of black keys located in its upper two-thirds portion, as compared with the rest of the one or more detected quadrilaterals. To determine which candidate quadrilateral has the highest brightness in its lower one-third portion, the means of all intensities in the lower one-third of all candidate rectangles are compared with each other and the one with the highest intensity is selected.

In some cases, the keyboard may not be successfully detected in the first video frame due to issues such as, for example, lighting and/or hands coverage. In some embodiments, the keyboard detection process is repeated for the next frames until the image of the keyboard is identified.

Once the keyboard is detected, the four points of the chosen quadrilateral, the keyboard quadrilateral, are stored and may be used for locating and transforming the working keyboard image, which is the image of the keyboard in subsequent video frames, using the same quadrilateral transformation, to convert a quadrilateral to a rectangular image, explained above. In addition, the image of the detected keyboard, which is a rectangular image of the keyboard quadrilateral taken from the video frame by cropping the remainder of the video frame, may be stored as the current background image.

In some embodiments, the background image is updated with an image from the image input in which the keyboard section has a higher average brightness in its bottom one third portion and more dark keys in its top two thirds portion than the keyboard section of the background image.

In some embodiments the background image may be updated using subsequent images of the image input, such as, for example, subsequent frames of a video. The subsequent images are analyzed to detect an image of the quadrilateral comprising the keyboard that has fewer dark keys in a lower one third of the image and more dark keys in the upper two thirds than the current background image. If an image of the keyboard is found with fewer dark keys in a lower one third of the image and more dark keys in the upper two thirds than the current background image, then the background image is replaced with the subsequent keyboard image.

Generally, a background image of the keyboard that has lower coverage of the keyboard by the hands is desirable over an image of the keyboard that has a higher proportion of the keyboard covered by the hands. In some situations, when the camera starts capturing the images of the performance on the keyboard, the musician's hands may have already covered the keyboard. In this case, the initial background image determined in the first frame and stored as the current background image, includes the hands as well. Noise and variations in lighting conditions during the performance may also affect the background image and the visibility of the keys in the background image. Updating the background image by analyzing subsequent frames for a background image with a higher visibility of the keys may provide for more robust key detection.

Referring again to FIG. 4, key detection at block 440 comprises determining locations and musical features, such as note names and octaves, of the dark and light keys, from the background image. The locations for the keys and the associated musical features are stored and used in detecting pressed keys.

Figure 6:
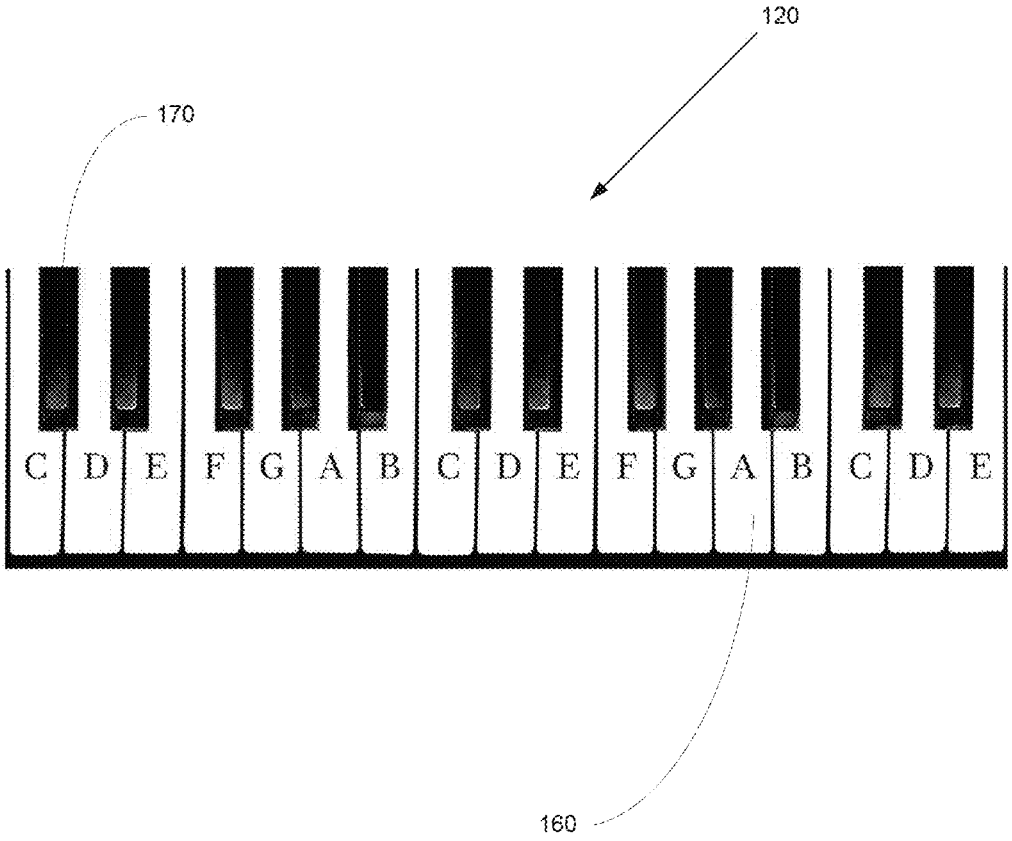
FIG. 6 is an example of a keyboard with key notations.

Referring to FIG. 6, a portion of the keyboard 120 is shown with notes labeled on the keys. In this embodiment, the keys include light keys 160 and dark keys 170. In some embodiments, the dark keys 170 may comprise black keys and the light keys 160 may comprise white keys.

Considering the dark keys as objects in a light background, such as, for example, black keys in a white background, they may located based on their contrast with a light background. For example, in one embodiment, locating each dark key comprises determining the location of each dark key using its contrast against a field of light keys.

In some embodiments, a blob detection and extraction technique, as discussed previously, may be used to extract the locations of the dark keys.

In certain embodiments, locating each key comprises determining coordinates of a keys quadrilateral, wherein the keys quadrilateral is a representation of the key. In some embodiments, the keys quadrilateral representing the general shape and size of each dark key is located and stored by determining the four corner points of the keys quadrilateral. The four corner points for each keys quadrilateral include the upper-left, upper-right, lower-right, and lower-left corners of the keys quadrilateral. These four corner points are extracted based on the intersections of left, top, right, and bottom edges of each dark key. For example, the intersection between the left and the top edges gives the upper-left point.

The light keys may be located relative to the dark keys. In one embodiment, standard dimensions of the keys of the keyboard are used to estimate dividing lines for the light keys based on the positions of the dark keys. For example, the standard dimensions of piano keys may be used if the keyboard is a piano or a keyboard using piano key dimensions or dimensions that are proportional to piano key dimensions.

The light keys on the keyboard may be located using the determined locations of the adjacent dark keys. There are also several light keys that have no black keys between them. The dividing lines for these light keys may be estimated based on the standard dimensions of the keyboard. Locations for the light keys may be approximated based on the locations of the estimated lines.

Any suitable method of locating the dividing lines between keys may be used. For example, four different relations between the dark keys and the light keys are used to determine the dividing lines for the light keys. These include:

1. A line separating the light keys G and A may be placed extending from a midpoint of a bottom of the dark key G#.
2. A line separating the light keys C and D may be positioned by extending a line down from a point positioned one-third of the distance along the bottom edge of the dark key C# from the right edge dark key C#. Similarly, a line separating the light keys F and G may be positioned by extending a line down from a point positioned one-third of the distance along the bottom edge of the dark key F# from the right edge dark key F#.
3. A line separating the light keys D and E may be placed by extending a line down from a point positioned one-third of the distance along the bottom edge of the dark key D# from the left edge dark key D#. Similarly, a line separating the light keys A and B may be placed by extending a line down from a point positioned one-third of the distance along the bottom edge of the dark key A# from the left edge dark key A#.

4. A line separating the light keys B and C may be located and placed by drawing a line extending from a top edge of the keyboard to a bottom edge of the keyboard and positioned mid-way between the dark key A# and the dark key C#. Similarly, a line separating the light keys E and F may be located and placed by drawing a line extending from the top edge of the keyboard to the bottom edge of the keyboard and positioned mid-way between the dark keys D# and F#.

In some embodiments, the estimated lines dividing the light keys may not always be vertical. This may be due, for example, to an imperfect image transformation transforming detected quadrilaterals to rectangular images. To draw the lines, in one embodiment, two different points are used. The first point is, for example, the point identified using any of the relations described in bullets 1 to 4 above for estimating lines between the light keys that do not have dark keys between them. The second point may be calculated from the first point and the slope of the line. The slope of the line is equal to the slope of a dark key used in determining first point.

In some embodiments, each light key may be modeled as the combination of two quadrilaterals. A first quadrilateral is placed at the upper two-thirds of the keyboard surrounded by the dark keys. The second quadrilateral may be placed at the lower one-third of the keyboard.

In certain embodiments, the keys quadrilateral representing each light key comprises a first and a second quadrilateral, the first quadrilateral representing a portion of the light key bordering a dark key and the second quadrilateral representing a remaining portion of the light key.

Musical features such as the octaves and the musical notes may be assigned to keys that have been identified and located. In one embodiment, the located keys may be assigned to octaves, wherein octaves are determined based on groups of sequentially arranged dark keys, each group comprising two dark keys separated from three dark keys only by two light keys. The octaves, identified by groupings of dark keys, may be numbered from left to right.

In some cases, the captured images do not include the entire keyboard with all octaves because of the position of the camera used to capture the images. In one embodiment, the octave numbers may be estimated by considering the middle visible octave as the octave including the Middle C key. The octave including the Middle C key is generally known as octave 4, so the middle visible octave may be assigned as octave 4. The other octaves located on the left and right may be numbered accordingly.

In some embodiments, the middle octave may be extracted by dividing the number of visible octaves by two. As discussed above, each octave of the keyboard includes five dark keys. The number of visible octaves is the number of dark keys, determined using, for example, the blob extraction technique discussed above, divided by five.

In certain embodiments, musical notes may be assigned to the located keys based on a comparison with a set of key notations. In some embodiments, musical notes may be assigned to the positional information of each detected key through a comparison with a set of key notations. For example, a list of standard assignments of notes to keys of a standard keyboard may be stored in the memory as a set of key notations. In some embodiments, notes may be assigned to the keys of the keyboard by matching the notes in the list to the keys of the keyboard. For example, notes may be mapped to the keys of the keyboard using a map of keys of a standard keyboard with assigned notes. In some embodiments, musical notes may be assigned based on the octave number.

The dark keys on the keyboard are divided into groups of two dark keys (C# and D#) and three dark keys (F#, G#, and A#). This pattern is repeated over the entire keyboard. The two groups are separated by two light keys. The spacing between the dark keys bounding the light keys separating the two groups is doubled as compared to the space between the dark keys within each group, which are separated by one light key. In some embodiments, the doubled space between the two groups of dark keys may be used to determine the associated musical notes for each dark key in each octave. Natural notes corresponding to the light keys are determined based on the notes of the dark keys and the estimated separating lines. For example, the two quadrilaterals which are separated by the line with the start point on the black key G# are assigned with the notes G and A.

In some embodiments, the notes may be assigned from left to right on the keyboard by assigning the notes C# and D# to the dark keys in the group of two dark notes and assigning the notes F#, G#, and A# to the dark keys in the group of three dark keys. Natural notes are assigned to the light keys based on the notes of the dark keys.

The locations of keys detected in the keyboard image are stored. The musical notes and octaves associated with the keys are also stored, each located key identifiable by its location. In some embodiments, the coordinates of the keys quadrilateral representing a key are stored as the location of the key.

In some embodiments, correction techniques may be used to reduce the effect of changing illumination, shadows, and noise in the images. Illumination changes may occur, for example, due to lighting changes during the performance and illumination may, in some cases, change in each video frame. Correcting for changes in illumination from frame to frame, noise, and shadows may, in some cases, make detection of pressed keys by comparing the working frame to the background image more robust.

One general method for reducing the effect of changing illumination, noise, and shadows (for example, hand shadows) in video processing is by decreasing the difference between the video frames (images). This method is similar to low pass (smoothing) filters used for averaging rapid changes in intensities.

In some embodiments, an image subsequent to the background image is normalized to reduce differences caused by illumination, noise, and shadows by adjusting pixel values in the image using pixel values in a previous image of the image input, wherein the image is normalized prior to detecting the pressed key. Each image is normalized prior to the transcribing application detecting pressed keys. In certain embodiments, pixel values for pixels in a current image are adjusted to have a pixel value between their current value and the pixel value of corresponding pixels in a subsequent image.

In some embodiments, a specific frame, such as, for example, the background frame, is considered as the overlay image. Then, based on the intensities in this overlay image, a low level manipulation of pixels may be performed in other video frames. As a result, minor differences (e.g. in illumination, noise, and/or shadows) between the overlay and other images may be reduced.

In some embodiments, a filter may be used to provide the low level manipulation of the pixels. Any suitable filters may be used. For example, a filter such as the MoveTowards filter may be used. The current background image may be used as the overlay image. The MoveTowards filter applies the following formula to each pixel in all video frames:

$$\mathrm{res} := frm + \min(|bgr - frm|, \mathrm{step}) \times \mathrm{Sign}(bgr - frm)$$

where frm and bgr are the pixel values in the source image (video frames) and the overlay image (current background image). The resulting pixel values are assigned to res. The parameter step defines the maximum amount of change per pixel in the source image. The min function returns the smallest value of its set of elements. The Sign function extracts the sign of (bgr−frm), returning a value of −1, 0, or +1.

Any suitable range of step sizes may be used. For example, in some embodiments, the range of the step size is from 0 to 255. The resulting image will be the same as the overlay image if the step size is 255 and it will be equal to the source image if the step size is 0. Having an appropriate step size results in reducing the minor differences caused by different illumination, noise, and shadows between the background image and other video frames. For example, in certain embodiments, a step size of 50 may be used.

Figure 7:
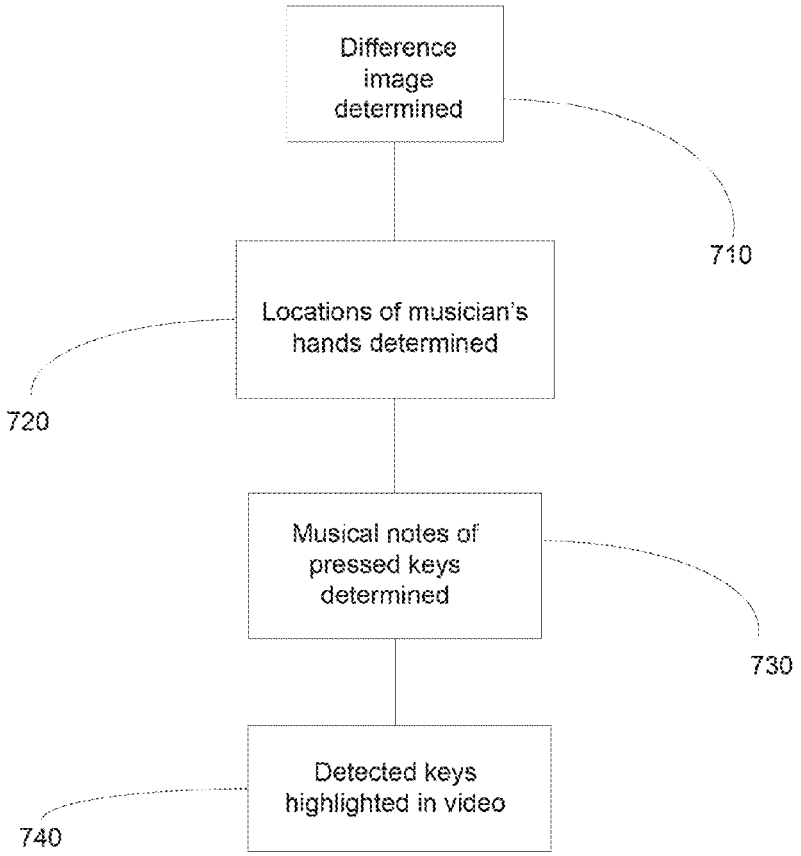
FIG. 7 is a set of tasks for determining the musical notes for pressed keys, according to one embodiment.

Referring to FIG. 7, tasks that may be performed, according to one embodiment, by the transcribing application in recognizing and mapping the played keys in each frame to the respective musical notes are shown. At block 710, a difference image between the background image and the image in subsequent frames is computed. The pressed keys may then be located based on the pixels identified in the difference image. In some embodiments, the image in each frame may be the normalized image with corrections applied to reduce the effects of illumination changes, shadows, and noise, as described above.

At block 720, locations of the musician's hands on the keyboard are determined. The locations of the musician's hands may be determined in order to identify the candidate keys potentially pressed by the musician. In one embodiment, a hand or a finger may be detected in the difference image and the locating of the pressed key may be limited to a region bounding the hand or the finger.

At block 730, the pressed keys are matched with their related musical features, such as notes and octaves. In one embodiment, the musical note for each pressed key is determined by mapping the keys quadrilaterals to the difference image and assigning to the pressed key the musical note associated with the mapped quadrilateral that includes the pressed key.

At block 740, the detected pressed keys are highlighted in the video frame according to their locations on the keyboard. In one embodiment, pressed keys are highlighted in each frame of the video by locating and highlighting keys quadrilaterals associated with pressed keys in each frame.

Pressing the keys on the keyboard causes some changes at the pixel values at the locations of the pressed keys. In order to detect these intensity variations of the pixels, a background subtraction technique is used. Pixels in the background image are subtracted from the corresponding pixels in subsequent images. For eight bit images, the resulting values may be between, for example, −255 and 255. However, the resulting values may fall in any suitable range and any suitable type of image may be used, such as a 16 bit image. The resulting difference image shows differences between the background image and the image being analyzed.

In some embodiments, comparing at least a portion of the keyboard in the background image to the keyboard in the subsequent image comprises subtracting the keyboard in the background image from the keyboard in the subsequent image to produce a difference image.

Figure 8:
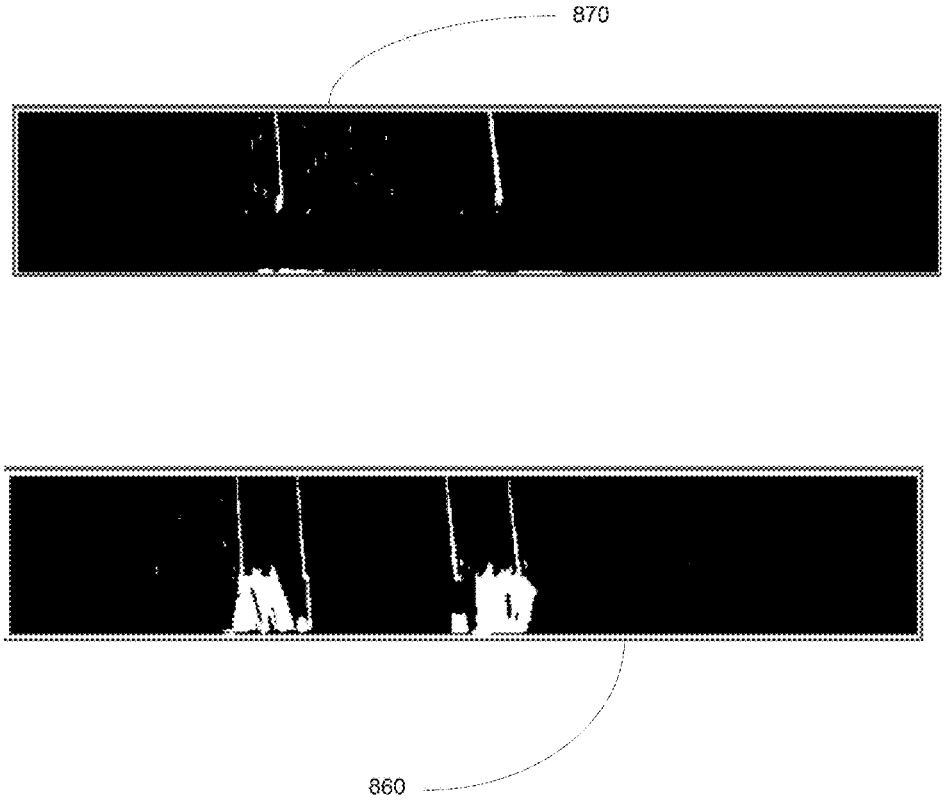
FIG. 8 is an example of positive and negative difference images.

In some embodiments, the positive and negative values resulting from the subtraction of the background image from the video frame being analyzed may be used separately in two separate difference images. Referring to FIG. 8, a positive difference image 870 shows changes caused by pressing the dark keys and a negative difference image 860 shows changes caused by pressing the light keys.

In certain embodiments, the difference image comprises positive difference image 870 and a negative difference image 860, the positive difference image 870 comprising positive pixel values and used for detecting a pressed dark key and the negative difference image 860 comprising negative pixel values and used for detecting a pressed light key.

When a dark key is pressed down on the keyboard, some of the dark pixels of the pressed dark key are replaced by the brighter pixels of the adjacent light keys in the image. The positive difference image 870 shows the brighter pixels of the adjacent light keys in place of the dark pixels of a portion of the pressed dark key. When a light key is pressed down on the keyboard, some of the light pixels of the pressed light key are replaced by the darker pixels of the adjacent dark keys in the image. The negative difference image 860 shows the darker pixels of the adjacent dark keys in place of the light pixels of a portion of the pressed light key. The darker pixels of the adjacent dark keys visible when the light key is pressed are shown as white in the negative difference image 860. In certain embodiments, the positive difference image 870 is used for locating a pressed key having negative pixel values and the negative difference image 860 is used for detecting a pressed key having positive pixel values.

Analyzing positive and negative differences separately may help to distinguish dark-to-bright and bright-to-dark pixel variations separately. Detecting the pressed light keys and the pressed dark keys separately may reduce the possibility of the light keys being incorrectly identified as their adjacent dark keys and vice versa.

Figure 9:
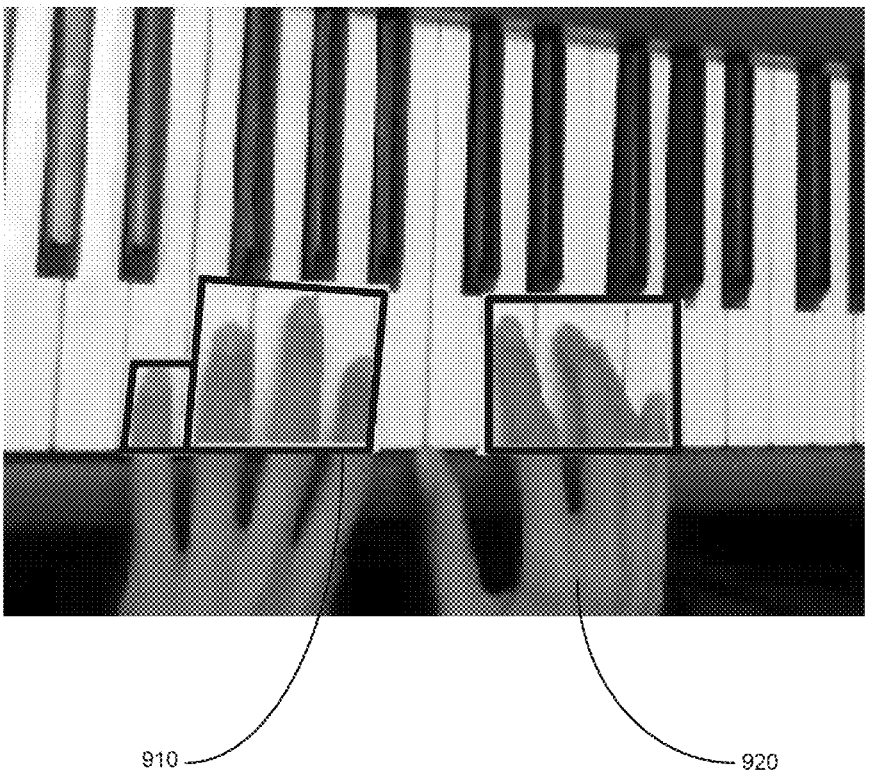
FIG. 9 is a screenshot of bounding boxes around hands playing a musical keyboard.

In some embodiments, the resulting difference images may be converted to corresponding binary images for blob extraction. The foreground pixels may be either a few blobs or some isolated pixels. In some embodiments, the positive and negative difference images 870, 860 are converted to binary positive and negative difference images Referring to FIG. 9, in some embodiments, locating the pressed keys may be limited to a region 910 around the musician's hands 920. By detecting the musician's hands 920 and creating a detection region 910 around the hands 920 for detecting and locating pressed keys, the speed at which the pressed keys are located may be increased and noisy detection results from other parts of the keyboard in which no hands 920 are present may be ignored.

Pixel intensities associated with skin colour are generally lower than those associated with the light keys, even in a grayscale image. Therefore, the hands 920 and fingers visible in an image of the keyboard may be determined using the difference image of the keyboard image in the video frame being analyzed. In some embodiments, a negative difference image 860 may be used to detect the musician's hands 920. Various techniques may be used for detecting the hands 920. For example, in one embodiment, blob detection techniques may be applied to a binary image of the difference image to extract and locate the musician's hands 920 and fingers. Bounding boxes 910 may be drawn around the musician's hands 920 and fingers. Any suitable size of bounding box 910 may be used. For example, in some embodiments, the size of the bounding box may be determined based on the smallest box that encloses the pixels detected as the hands. In certain embodiments, the dimensions of the bounding box 910 may be adaptively chosen based on the dimensions of the portion of the hands that covers the keyboard.

In some embodiments, the bounding boxes 910 may be reversibly transformed and shown in the original images on a GUI.

The difference images and the location and associated musical notes for the keys of the keyboard may be used to detect the notes played by the musician in subsequent video frames. In some embodiments, locating pressed keys and assigning notes to them may be limited to keys falling within the bounding box 910 around the musician's hands 920.

In certain embodiments, the musical note for each pressed key may be determined by assigning to each pressed key the musical note associated with the located key in the current background image that corresponds to a location of the pressed key. The musical note may be determined separately for pressed light keys detected in the negative difference image 860 and pressed dark keys detected in the positive difference image 870.

In some embodiments, the musical note for each pressed key is determined by mapping the keys quadrilaterals to the difference image and assigning to the pressed key the musical note associated with the mapped keys quadrilateral that includes the pressed key.

In some embodiments, the musical note is determined for the pressed key by using blob extraction to detect the presence of a blob in a region of the difference image corresponding to one of the keys located in the current background image. The associated musical note is assigned to the pressed key, wherein blob extraction is used to locate the pressed key in the difference image. In certain embodiments, the presence of a blob in a region of the difference image corresponding to the keys quadrilateral representative of one of the located keys may be used for assigning the associated musical note to the pressed key.

In some embodiments, the musical note for each pressed light key comprises using blob extraction to detect the presence of a blob in a region of the difference image corresponding to the first quadrilateral representative of one of the located light keys and assigning the associated musical note to the pressed key.

In some embodiments, each location on the difference image corresponding to the keys located in the background image is searched for the presence of a pressed key. If a pressed key is present, the musical note associated with the located key of the background image is assigned to the pressed key. The search may be, for example, a linear search. In some embodiments, the search may be a binary search. In certain embodiments, any suitable search method may be used. In some embodiments, the search may be conducted separately for pressed light keys and pressed dark keys in the negative difference image 860 and the positive difference image 870, respectively.

In one embodiment, the musical notes played by the musician in subsequent video frames may be determined using a list of located keys of the background image and associated musical notes, the negative and positive difference images 860, 870 and the location of the hands. In this embodiment, a key is considered pressed if:

1. it is located in at least one of the bounding boxes 910 around the hands 920;
2. its associated quadrilateral in the difference image includes at least one blob; and
3. the length of the considered blob is at least half of the key's length.

The light and dark keys, identified by the first condition are searched in the binarized positive and negative difference images 860 and 870. The third condition may reduce the possibility that the considered blob is noise.

In some embodiments, for the light keys with no dark key in between (e.g., E and F), blobs may appear for both keys. The one with more blobs may be selected as the pressed key. If the number of blobs is the same, the key with more isolated pixels in its associated quadrilateral may be chosen.

There may also be blobs present representing the musician's hands 920. In some embodiments, the second (lower) quadrilateral used to model the light keys may be excluded in the search because it is mostly covered by the hands.

In some embodiments, note duration is also recorded by determining when a key is first detected as being pressed and when it is no longer detected as being pressed. Frames in which no key is pressed may be recorded as rests and the duration of rests may be similarly recorded. In some embodiments, note duration is determined by timing the length of time the pressed key is pressed for. The duration for a rest is the time for which no pressed keys are detected subsequent to an initial key press marking the start of the musical performance.

Any suitable highlighting methods may be used. For example, in some embodiments, pressed keys are highlighted in frames of the original video by locating and highlighting quadrilaterals associated with pressed keys in each frame. In some embodiments, the original positions of their associated quadrilaterals are first calculated by reversing the transformation used to transform the quadrilateral image of the keyboard to a rectangular image of the keyboard to map the key quadrilaterals to the original, untransformed images. The key quadrilaterals corresponding to pressed keys may be highlighted by, for example, drawing coloured polygons over them.

In some embodiments, sheet music may be produced as an output by the transcribing application by mapping the musical notes to a corresponding musical symbol based on the note duration and arranging the musical symbol in a staff based on the musical note. In some embodiments, the sheet music further comprises musical symbols arranged in a staff corresponding to musical notes determined for previous frames of the video. The musical symbols may be arranged based on the order the musical notes were determined. The transcribing application may update the sheet music in real time as the video is processed by adding musical symbols to the staff as they are determined. In some embodiments, the musical notes are arranged in the staff based on their associated octave number.

In some embodiments, played notes may be transcribed to a Musical Instrument Digital Interface ("MIDI") structure. Features such as the note name, the octave number, and the note duration may be used to transcribe the pressed keys to a MIDI structure.

Features related to each pressed key, such as, for example, the location or positional information, the octave number, and the musical note, may be added to a list, which may, for example, be named PlayedList. PlayedList indicates the played notes in video frames subsequent to the keyboard detection frame.

Note duration, in some embodiments, may be determined by timing the length of time each pressed key is pressed for. For example, in one embodiment, note duration may be determined by determining the difference in time between when a key is first detected as being pressed and when it is no longer detected as being pressed.

In certain embodiments, note duration may be calculated by obtaining onset and offset times (attack and release times) of the played note. The following procedure may be used by the transcribing application to identify the onset and offset of each played note:

1. A temporary list, for example named PreList, indicating the onset/offset status of previous played notes is defined.

2. Once a played note is detected and added to PlayedList in video frame frames subsequent to the keyboard detection frame, the transcribing application checks PreList for the note. If the note does not exist PreList, its onset is computed and attached to the note features. Then, the note including its features is added to PreList. The real-time synthesized MIDI sound of the corresponding note is played at the same time. If the note exists in PreList, the note is still being played by the musician and PreList remains unchanged.
3. In video frames subsequent to the keyboard detection frame, the notes in PreList are checked for their presence in PlayedList. If there is a note in PreList that does not exist in PlayedList, it means it has been released by the musician. The current time is considered as the note offset attached to the note features. Playing of the synthesized MIDI sound of the corresponding note is stopped. The current released note is removed from PreList.

The note features such as name, octave number, and onset/offset may be used to create a MIDI event including the Note On and Note Off messages related to each played note. These events can be added to a collection on the memory used for storing MIDI events produced in video frames subsequent to the keyboard detection frame. A MIDI stream may be used to store this collection. Other corresponding MIDI values such as the instrument name, tempo, and time signature may be manually determined and entered into the GUI 205 by the user. In some embodiments, if the user does not enter values such as the instrument name, tempo, and time signature, they may be automatically assigned as, for example, acoustic grand piano, 120 beats per minute, and $_4^4$ respectively. In certain embodiments, other suitable default values may be used. By adding these values, the MIDI stream is regarded as a complete MIDI structure representing the transcription of the played music. The MIDI structure may be stored and played back.

The constructed MIDI file may be converted to the corresponding sheet music by assigning musical symbols to the notes based on their duration and arranging the musical symbols in a staff based on the note name. Any suitable application may be used for converting the MIDI file to sheet music. For example, the Midi Sheet Music library (M. Vaidyanathan, Midi sheet music. http://midisheetmusic.sourceforge.net) may be used to convert the MIDI file to sheet music.

Figure 10:
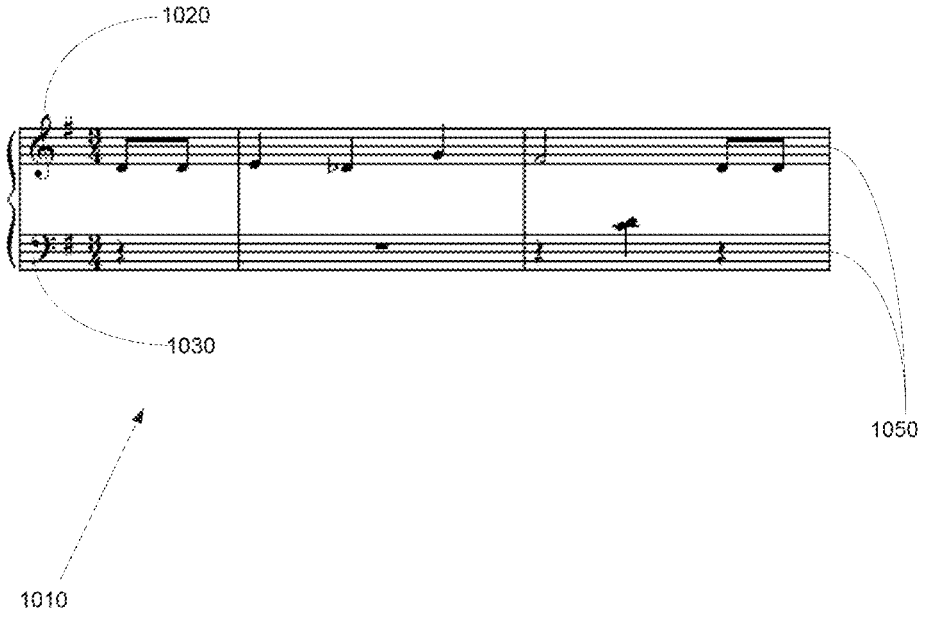
FIG. 10 is an example of sheet music that may be output by the system of FIG. 1.

As shown in FIG. 10, the sheet music 1010 may be displayed with appropriate features and symbols, such as, for example, time and key signatures, measures including vertical bars, notes and rests with their durations, and chords. The sheet music 1010 is made up of a grand staff 1050 including a treble clef 1020 for higher notes and a bass clef 1030 for lower notes. The notes played in the first octaves (from 1 to 3) are written in the staff with the treble clef and the ones in the last octaves (from 4 to 7) are written in the staff with the bass clef.

The methods described above, including each block of the flowcharts and block diagrams and combinations thereof can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions or acts specified in the blocks of the flowcharts and block diagrams.

In one embodiment, a non-transitory computer readable medium has stored thereon program code to cause a processor to perform a method for transcribing music played on a musical instrument having a keyboard. The method includes any of the methods discussed herein.

Video processing may generally use significant system resources, requiring long processing times and significant memory usage. In some embodiments, the transcribing application may be implemented using techniques to reduce resource usage of the computer. For example, in one embodiment, video frames (images) are initially converted to unmanaged images (managed by user code). Unmanaged images use unmanaged memory buffers and, unlike managed images, do not require lock/unlock operations. As a result, it is possible to apply faster image processing routines with lowered overhead. In addition, in some embodiments, colour images may be converted to grayscale images to decrease both processing time and memory usage.

In some embodiments, the transcribing application may use multi-threading to reduce processing times. Multi-threaded programming is an execution model that allows multiple threads to exist and share resources (e.g., memory) in a single program (process). Threads are synchronized to permit them to communicate and share resources with one another. Splitting a process into parallel sub-tasks may result in faster execution.

In some embodiments, the transcribing application uses four threads. The first running thread is the main thread. It is used for controlling the user interface of the transcribing application including the tools for image capturing and processing. This thread may also be used for transmitting the images from the camera and displaying it in a display of the transcribing application. In some embodiments, the illumination normalization and pressed keys detection may also be executed in this thread.

A second thread is used for keyboard detection and registration. Keyboard registration may be performed in the first few frames of the video and may consume significant amounts of time compared to other tasks performed by the transcribing application. Keyboard registration may delay, for example, the transmitting of video frames from the camera to the transcribing application and showing the images in the user interface. For these reasons, in some embodiments, keyboard registration is performed in a separate thread.

A third thread is used for updating the current background image. Every frame subsequent to the initial selection of the current background image is analyzed to see if it may be used to replace the current background image, making this task a resource heavy task.

A fourth thread may be used by the transcribing application for constructing the MIDI file based on a new played note every time a key is pressed, converting it to the sheet music, and displaying the produced sheet music. Using a separate thread for this task may increase the speed of producing the sheet music and may decrease the processing time needed for analyzing the video frames.

Testing and Evaluation Results

The performance of one embodiment of the transcribing application, claVision, is evaluated based on accuracy and processing time. The transcribing application is installed and tested on a laptop with an Intel Core i7-4160U CPU (2.00 GHz) and 16 GB DDR3 RAM.

Images of musical performances using a keyboard with black and white keys are captured using two different digital cameras, an SD 240p webcam (with a resolution and a frame rate of 320×240 pixels and 24 FPS respectively) and an HD 870p webcam (with a resolution and a frame rate of 640×360 pixels and 30 FPS respectively). Table 1 presents the list of the test videos with their features used in this evaluation.

TABLE 1

List of the sample videos including different slow and fast pieces of music (the column "Number of Keys" shows the number of visible white and black keys in the video).

| Video ID | Number of Frames | Resolution | Frame Rate (FPS) | Number of Keys | Keyboard Type | Speed (Tempo) |
|---|---|---|---|---|---|---|
| V1 | 2596 | 320_240 | 24 | 35 | Piano | Slow (40 BMP) Slow |
| V2 | 1048 | 640_360 | 30 | 88 | Piano | (60 BMP) Medium |
| V3 | 2090 | 640_360 | 30 | 60 | Electronic | (80 BMP) Medium |
| V4 | 1491 | 640_360 | 30 | 60 | Electronic | (80 BMP) Medium |
| V5 | 857 | 640_360 | 30 | 60 | Electronic | (120 BMP) Fast (140 |
| V6 | 4502 | 640_360 | 30 | 88 | Piano | BMP) Fast ( 200 |
| V7 | 2281 | 640_360 | 30 | 60 | Electronic | BMP) |
| V8 | 3607 | 640_360 | 30 | 66 | Piano | Very Fast (240 BPM) |

The effectiveness of the system in performing different tasks is evaluated based on accuracy and processing time. The processing times for different tasks performed by the system are summarized in Table 2. They are sufficiently low to provide real-time processing of the videos evaluated.

TABLE 2

Processing times of different steps in claVision

| Step | Processing Time (ms) Maximum | Average |
|---|---|---|
| Keyboard Detection | 1100 | 691.9 |
| Background Update | 53 | 6.1 |
| Keys Detection | 20 | 16.6 |
| Image Correction | 6.0 | 1.8 |
| Pressed Keys Detection | 45 | 6.6 |

The locations of the keyboard in all sample images are successfully detected. The keys detection task has a very high accuracy of 95.2% and a very low processing time. The processing times during keyboard registration, including keyboard detection, background updating, and keys detection do not affect the real-time processing because it is performed in a separate thread. According to the evaluation results, issues such as varying illumination conditions and noise are satisfactorily dealt with using the image correction technique. This technique has a low average processing time of 1.8 ms, and does not cause significant latency for real-time processing.

The transcribing application show high accuracy in pressed keys detection with recall and precision rates of 97.5% and 97.4%, as shown in Table 3. Recall is the percentage of keys correctly detected as being pressed. Precision rate is the ratio of keys correctly detected as being pressed to the total number of keys detected as being pressed. The total number of keys detected as being pressed includes the keys correctly detected as being pressed and false detections, where a key that is not pressed is detected as being pressed.

TABLE 3

Test results of pressed keys detection. All frames in the sample videos were considered for calculating these results.

| Video | Recall % | Precision % |
|---|---|---|
| V1 | 96.5 | 96.2 |
| V2 | 100 | 96.8 |

TABLE 3-continued

Test results of pressed keys detection. All frames in the sample videos were considered for calculating these results.

| Video | Recall % | Precision % |
|---|---|---|
| V3 | 98.5 | 99.4 |
| V4 | 96.6 | 99.1 |
| V5 | 97.9 | 93.2 |
| V6 | 96.9 | 96.8 |
| V7 | 97.4 | 99.3 |
| V8 | 96.4 | 98.3 |
| Average: | 97.5 | 97.4 |

There is a latency of 6.6 ms for the pressed keys detection stage. This is relatively low compared to the other times in the system and the time that a frame is displayed for. The system is able to successfully transcribe video streams recorded at 30 FPS. The synthesized MIDI file is accurately produced.

Figure 11:
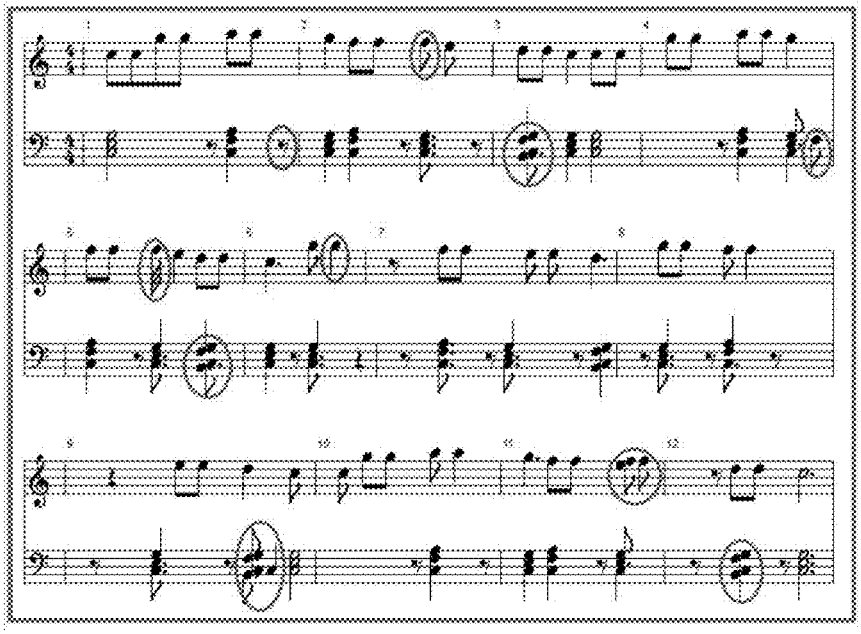
FIG. 11 is a second example of sheet music with that may be output by the system of FIG. 1.

To evaluate the correctness of the transcribed music produced by claVision, the sheet music of the song performed in the sample video V5 is analyzed. The played song is Twinkle Twinkle Little Star. No black keys are played in this music. Referring to FIG. 11, the sheet music 1100 produced by claVision is shown. Ten notes, marked with circles in FIG. 11, are incorrectly transcribed in this piece due to ten keys falsely detected as being pressed. The precision rate for this video, 93.2%, is the lowest out of the eight test videos and well below the average precision rate of 97.4%.

Alternatives

Acoustic AMT techniques use audio processing techniques to analyze, for example, the pitches and frequencies in a piece of music in order to extract the played notes. In certain embodiments, VAMT may be combined with audio based or acoustic AMT techniques. Any suitable acoustic AMT technique may be used.

In some embodiments, the image input, comprising video and audio input, may be processed by the transcribing application using both VAMT and acoustic AMT methods. The output may include both an output based on the musical notes detected using VAMT and acoustic AMT. In some embodiments, musical notes might be determined based either on VAMT or acoustic AMT. For example, musical notes for keys that may be less detectable than other keys may be determined using acoustic AMT while musical notes for the remaining keys may be determined using VAMT techniques.

In certain embodiments, a musical note may be determined using both VAMT and acoustic AMT techniques. However, the output may include a musical note determined by either the VAMT technique or the audio based AMT technique.

In certain embodiments, if the pressed key is one that has low visual detectability, the note determined using the acoustic AMT technique may be used for the output whereas if the pressed key does not have low visual detectability, the musical note determined using VAMT techniques may be used for the output. For example, the visually determined musical note determined may be replaced with the acoustically determined musical note if the pressed key corresponds to a key with low visual detectability.

Keys with low visual detectability may include, for example, light keys with no dark keys between them and dark keys that are captured in the image input positioned such that the light keys separating them are difficult to detect. For example, the input image may be captured from an angle that causes some of the dark keys to appear to be joined together or with very small portions of a light key visible between them. If the portion of the light key visible is too small to be considered as a detected key in a difference image, one or both of the dark keys bordering the light key may be considered to have low visual detectability. Keys covered by hands may also be considered to have low visual detectability. In some embodiments, if an acoustic note is present but the corresponding key is under a hand and not detected visually, the acoustically determined note may be used.

Supplementing VAMT using acoustic AMT techniques may increase the overall accuracy of the system by using acoustic AMT to determine notes for pressed keys that have low visual detectability.

The terminology used herein is for the purpose of describing particular embodiments only and is not intended to be limiting. Accordingly, as used herein, the singular forms "a", "an" and "the" are intended to include the plural forms as well, unless the context clearly indicates otherwise. It will be further understood that the terms "comprises" and "comprising," when used in this specification, specify the presence of one or more stated features, integers, steps, operations, elements, and components, but do not preclude the presence or addition of one or more other features, integers, steps, operations, elements, components, and groups.

It is contemplated that any part of any aspect or embodiment discussed in this specification can be implemented or combined with any part of any other aspect or embodiment discussed in this specification.

While particular embodiments have been described in the foregoing, it is to be understood that other embodiments are possible and are intended to be included herein. It will be clear to any person skilled in the art that modifications of and adjustments to the foregoing embodiments, not shown, are possible.

The invention claimed is:

1. A computer implemented method of transcribing music played on a musical keyboard instrument comprising keys, the method comprising using a processor for:

(a) receiving an image input of the musical keyboard instrument being played, comprising at least a played portion of the musical keyboard instrument, wherein the image input is captured from a position showing changes in position of the keys;

(b) locating a keyboard section of a background image of the image input;

(c) assigning a musical note to each of the keys located in the keyboard section;

(d) locating pressed keys in an image subsequent to the background image by comparing at least a portion of the keyboard section of the background image to a keyboard section of the subsequent image;

(e) determining a musical note for each of the pressed keys based on the musical note assigned to a corresponding one of the keys in the keyboard section of the background image; and (f) outputting an output wherein the output is a musical notation transcribed from the musical notes determined for the pressed keys.

2. The method of claim 1 wherein comparing at least a portion of the keyboard section in the background image to the keyboard section in the subsequent image comprises subtracting the keyboard section in the background image from the keyboard section in the subsequent image to produce a positive difference image and a negative difference image, the positive difference image comprising positive pixel values and the negative difference image comprising negative pixel values.

3. The method of claim 1 wherein the keyboard section of the background image comprises light keys and dark keys, the keyboard section is located by analyzing the image input, detecting at least one quadrilateral in the image input and selecting from the at least one detected quadrilateral a keyboard quadrilateral in which a bottom one third portion has a higher average brightness and a top two thirds portion comprises more dark keys than any other detected quadrilateral.

4. The method of claim 1 wherein the background image is updated with an image from the image input in which the keyboard section, comprising light keys and dark keys, has a higher average brightness in its bottom one third portion and more dark keys in its top two thirds portion than the keyboard section of the background image.

5. The method of claim 1 wherein the image input comprises a previous image, the subsequent image is subsequent to the background image and the previous image, the subsequent image is normalized to reduce differences caused by illumination, noise, and shadows prior to locating the pressed keys, the subsequent image is normalized by adjusting pixel values in the subsequent image using pixel values in the previous image.

6. The method of claim 1 further comprising using the processor for detecting a hand and/or a finger in the subsequent image and limiting locating at least one of the pressed key to a region bounding the hand and/or the finger.

7. The method of claim 1 wherein the keys in the background image comprise dark keys and the method further comprises using the processor for locating the keys wherein the keys are located by locating dark keys using their contrast with light keys and determining positions for the light keys relative to the dark keys.

8. The method of claim 1 wherein the keys in the background image are located by determining coordinates of a keys quadrilateral for each of the keys, the keys quadrilateral being a representation of the key.

9. The method of claim 8 wherein determining the musical note for a particular one of the pressed keys comprises mapping the keys quadrilaterals to positive or negative difference images and assigning to the particular pressed key the musical note associated with the mapped quadrilateral that includes the particular pressed key.

10. The method of claim 1 further comprising using the processor for assigning the keys to octaves, wherein the keys comprise dark keys and light keys and wherein octaves are determined based on groups of sequentially arranged dark keys, each group comprising two dark keys separated from three dark keys by two adjacent light keys.

11. The method of claim 1 wherein the image input comprises a video.

12. The method of claim 1 wherein the musical notation is output as sheet music.

13. The method of claim 12 wherein the sheet music is produced by mapping the musical note of a particular one of the pressed keys to a corresponding musical symbol based on note duration and arranging the musical symbol in a staff based on the musical note, wherein note duration is determined by a length of time during which the particular pressed key was pressed.

14. The method of claim 1 further comprising using the processor for transforming the keyboard section of the background image into a rectangular image.

15. The method of claim 1 further comprising using the processor for highlighting one of the pressed keys in an image of the image input.

16. The method of claim 1 wherein the image input further comprises audio input, and the method further comprises using the processor for acoustically determining the musical note for a particular pressed key using acoustic automatic musical transcription.

17. The method of claim 16 wherein the output is based on the acoustically determined musical note if either the particular pressed key or the acoustically determined musical note corresponds to one of the keys that has low visual detectability.

18. A non-transitory computer readable medium having stored thereon program code to cause a processor to perform a method for transcribing music played on a musical instrument having a keyboard with keys, the method comprising:

(a) receiving an image input of the musical instrument being played, comprising at least a played portion of the keyboard, wherein the image input is captured from a position showing changes in position of the keys;

(b) locating a keyboard section of a background image of the image input;

(c) assigning a musical note to each of the keys located in the keyboard section;

(d) locating pressed keys in an image subsequent to the background image by comparing at least a portion of the keyboard section of the background image to a keyboard section of the subsequent image;

(e) determining a musical note for each of the pressed keys based on the musical note assigned to a corresponding one of the keys in the keyboard section of the background image; and (f) outputting an output wherein the output is a musical notation transcribed from the musical notes determined for the pressed keys.

19. A computer implemented method of locating keys played on a musical keyboard instrument, the method comprising using a processor for:

(a) receiving an image input of the musical keyboard instrument being played, comprising at least a played portion of the musical keyboard instrument, wherein the image input is captured from a position showing changes in position of the keys;

(b) locating a keyboard section of a background image of the image input;

(c) locating the keys in the keyboard section;

(d) locating pressed keys in an image subsequent to the background image by subtracting the keyboard section of the background image from the keyboard section of the subsequent image to produce a positive difference image and a negative difference image, wherein the positive difference image is used for locating one of the pressed keys having negative pixel values and the negative difference image is used for detecting one of the pressed keys having positive pixel values; and (e) outputting an output wherein the output is a musical notation transcribed from musical notes determined for the pressed keys.

20. A system for automatically visually detecting musical notes played on a musical keyboard instrument comprising keys, the system comprising:

(a) a camera for providing an image input of the musical keyboard instrument being played, comprising at least a played portion of the musical keyboard instrument, wherein the image input is captured from a position showing changes in position of the keys;

(b) a computing device communicatively coupled to the camera, the computing device comprising a computer readable memory and a processor operably coupled with the computer readable memory; and (c) a transcribing application stored on the computer readable memory for execution by the processor for receiving the image input, locating a keyboard section of a background image of the image input and assigning musical notes to the keys located in the keyboard section, locating a pressed key in an image subsequent to the background image by comparing at least a portion of the keyboard section of the background image to a keyboard section of the subsequent image, determining a musical note for each of the pressed keys based on the musical note assigned to a corresponding one of the keys in the keyboard section of the background image and outputting an output, wherein the output is a musical notation transcribed from the musical notes determined for the pressed keys.

* * * * *